US005375373A

United States Patent [19]

Tiede

[11] Patent Number: 5,375,373

[45] Date of Patent: Dec. 27, 1994

[54] GRILLE FOR SECURITY INSTITUTIONS

[75] Inventor: Irvin R. Tiede, Sherwood Park, Canada

[73] Assignee: Multi-Line Enterprises Ltd., Canada

[21] Appl. No.: 147,899

[22] Filed: Nov. 4, 1993

Related U.S. Application Data

[63] Continuation of Ser. No. 9,656, Jan. 27, 1993, abandoned.

[30] Foreign Application Priority Data

Jan. 29, 1992 [CA] Canada ..... 2060234

[51] Int. Cl.[5] ..... E06B 3/68

[52] U.S. Cl. ..... 49/50; 52/473; 454/82

[58] Field of Search ..... 49/50; 52/656.8, 473; 454/284, 82

[56] References Cited

U.S. PATENT DOCUMENTS

| | | | |
|---|---|---|---|
| 68,076 | 8/1867 | Hoffman | 52/473 X |
| 1,400,860 | 12/1921 | Brown | 454/82 X |
| 1,673,906 | 6/1928 | Fager | 52/473 X |
| 1,703,437 | 2/1929 | Wills | 454/82 X |
| 2,354,466 | 7/1944 | Levinsen | 454/82 X |
| 3,125,196 | 3/1964 | Fenner | 52/473 |
| 4,189,990 | 2/1980 | Kittler | 52/473 X |
| 4,911,066 | 3/1990 | Carew | 52/473 X |

FOREIGN PATENT DOCUMENTS

| | | | |
|---|---|---|---|
| 566079 | 7/1977 | U.S.S.R. | 454/284 |

*Primary Examiner*—Peter M. Cuomo
*Assistant Examiner*—Jerry Redman
*Attorney, Agent, or Firm*—Davis, Bujold & Streck

[57] ABSTRACT

A grille for security institutions consists of a body having two opposed faces. At least one passage extends through the body between the opposed faces. The passage has at least two changes in direction defining a generally zig zag course. When a rope is inserted into the passage the series of direction changes severely limit the ability of a person to thread the rope through the passage.

6 Claims, 2 Drawing Sheets

GRILLE FOR SECURITY INSTITUTIONS

This is a continuation of copending application(s) Ser. No. 08/009,656 filed on Jan. 27, 1993, now abandoned.

BACKGROUND OF THE INVENTION

The term "security institution" is intended to refer to penal facilities and mental health facilities where, for the protection of the public, persons under the care of the institution must be confined. Grilles are gratings which cover openings. In this context we are primarily concerned with air grilles, that cover air flow openings in the ventilation system. Air grilles intended for installation in such security institutions must be of reinforced construction in order to prevent the escape of the inmates. An ongoing problem with such air grilles has been the propensity of some inmates to inflict injury upon themselves by suspending themselves from the air grilles. A number of deaths have occurred as a result of such "hangings". The inmates hang themselves from the air grilles by threading a makeshift rope made of braided material through an air passage, up over a structural member of the air grille and back down where it can be tied.

SUMMARY OF THE INVENTION

What is required is a grille which will render it extremely difficult, if not impossible, for inmates to thread a makeshift rope through a passage for the purpose of inflicting personal injury upon themselves by "hanging".

According to the present invention there is provided a grille for security institutions which is comprised of a body having two opposed faces. At least one passage extends through the body between the opposed faces. The passage has at least two changes in direction defining a generally zig zag course. When rope-like suspension means are inserted into the passage the series of direction changes severely limit the ability of a person to thread the rope-like suspension means through the passage.

Although beneficial results may be obtained through the use of the grille as described, another method inmates have used in the past to secure a rope for the purpose of hanging themselves is to attach an object (such as a handle of a knife, fork or spoon) to a makeshift rope, extend the object partially through one of the air passages and then lodge the object sideways in the air passage such that the rope is suspended from the lodged object. Even more beneficial results may be obtained if care is taken in the cross-sectional dimensions of the passage to severely restrict the shape of object that can be inserted into the passage and the ability of a person to lodge such object transversely in the passage. The preferred shapes are circles or elongate slots.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
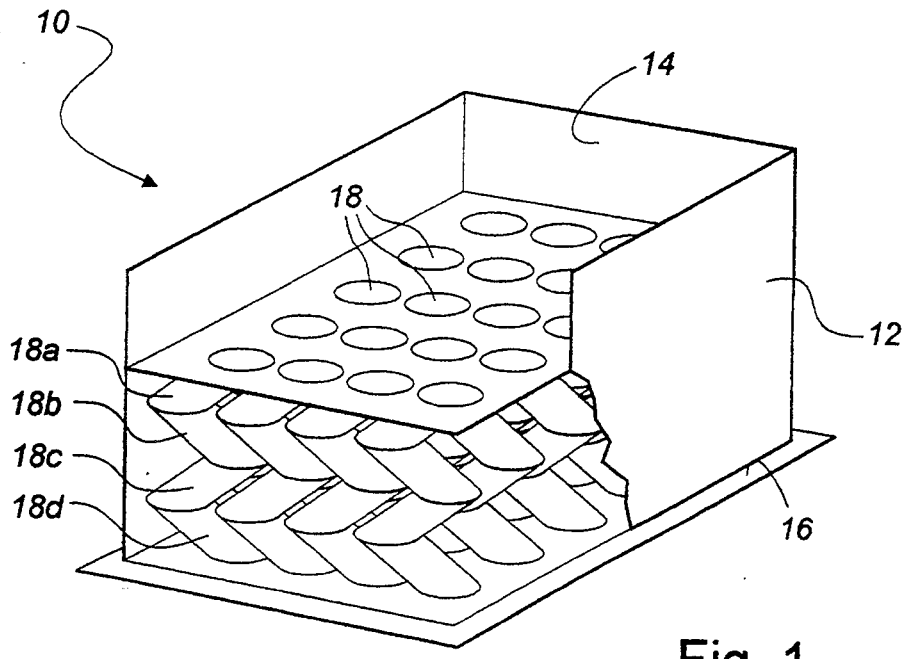
FIG. 1 is a cut away perspective view of a preferred embodiment of a grille constructed in accordance with the teachings of the present invention.

The preferred embodiment, a grille for security institutions generally identified by reference numeral 10, will now be described with reference to FIGS. 1 and 2.

Figure 2:
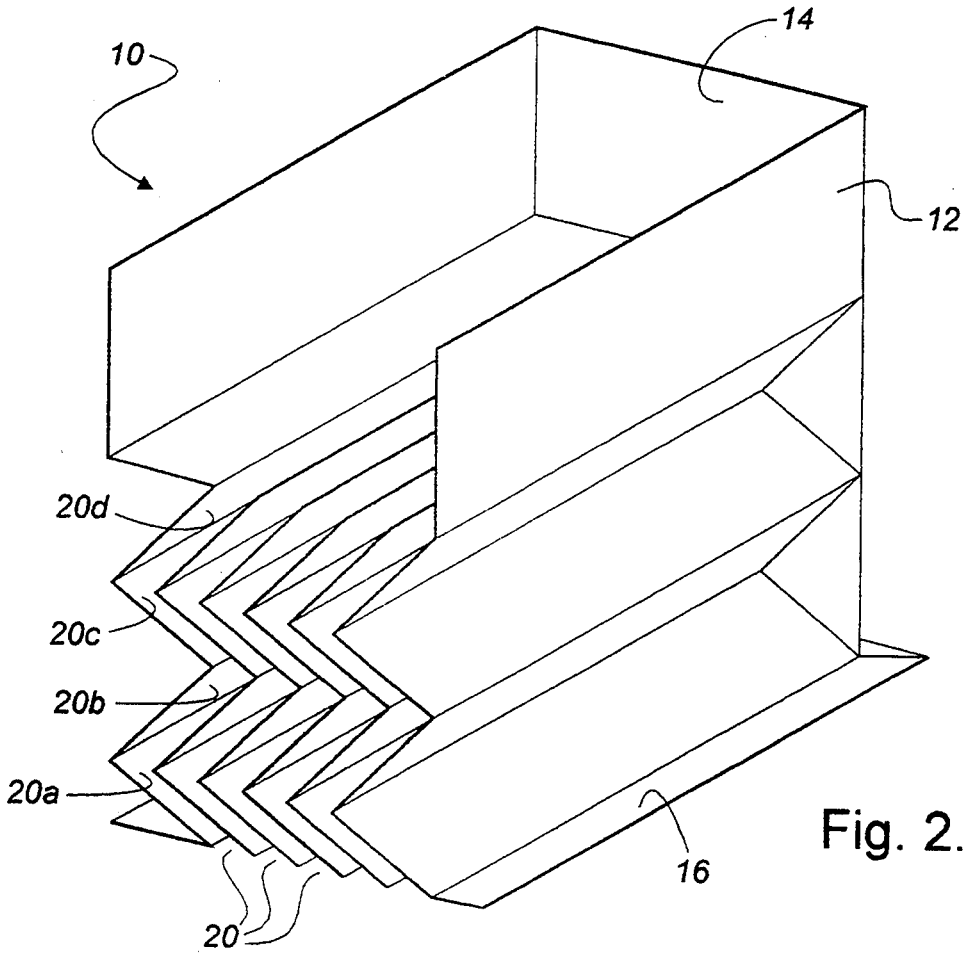
FIG. 2 is a cut away perspective view of an alternate embodiment of a grille constructed in accordance with the teachings of the present invention.
Figure 3:
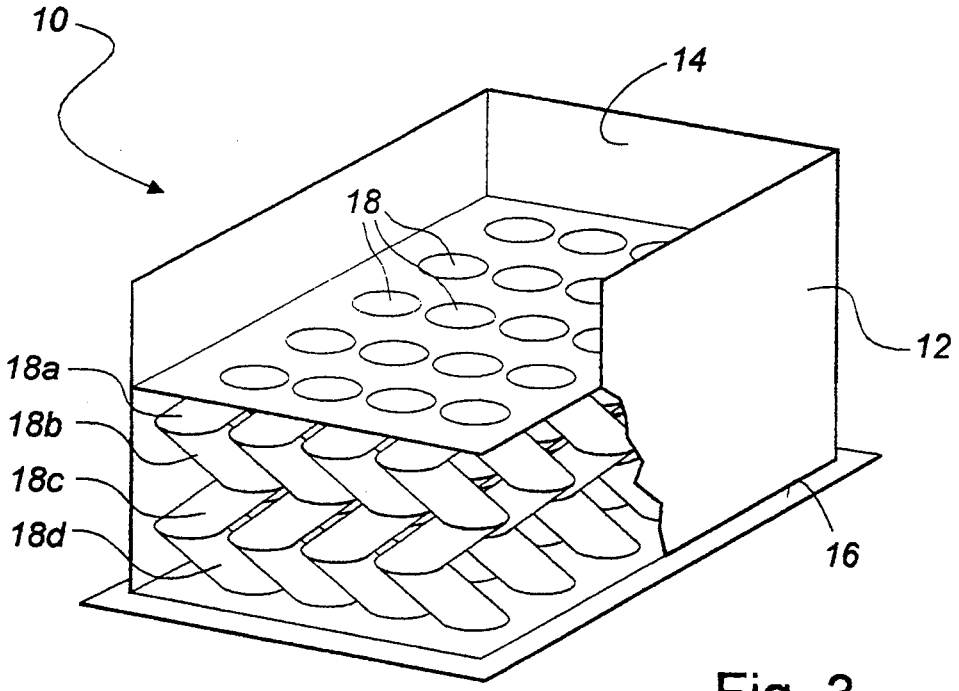
FIG. 3 is a cut away perspective view of a further alternate embodiment of a grille constructed in accordance with the teachings of the present invention.

Referring to FIGS. 1 and 2, there are illustrated two alternate preferred embodiments of grille 10. Both alternate embodiments of grille 10 consist of a body 12 having two opposed faces 14 and 16. In FIG. 1, a plurality of passages 18 extend through body 12 between opposed faces 14 and 16. Each of passages 18 has a plurality of changes in direction defining a generally zig zag course, as identified by reference numerals 18*a*, 18*b*, 18*c*, and 18*d*. In FIG. 2, a plurality of passages 20 extend through body 12 between opposed faces 14 and 16. Each of passages 20 has a plurality of changes in direction defining a generally zig zag course, as identified by reference numerals 20*a*, 20*b*, 20*c*, and 20*d*. The difference between passages 18 as illustrated in FIG. 1 and passages 20 as illustrated in FIG. 2 lies in the cross-sectional dimension of the respective passages. As is apparent from a review of the FIGS. 1 and 2, passage 18 is generally circular and passage 20 is in the form of an elongate slot. FIG. 3 shows the passage 18 to be of a generally elliptical configuration.

The use and operation of grille 10 will now be described. When a makeshift rope, string, wire, or other rope-like suspension means are inserted into passages 18 or 20 the series of direction changes (18*a*, 18*b*, 18*c*, 18*d* or 20*a*, 20*b*, 20*c*, 20*d*) severely limit the ability of a person to thread the rope-like suspension means through passage 18 or 20. If the rope-like suspension means cannot be threaded through the passage, the primary method of securing the rope for the purpose of hanging oneself is eliminated. The cross-sectional dimensions selected severely restrict the shape of object that can be inserted into either passage 18 or 20 and the ability of a person to lodge such object transversely in either passage.

It will be apparent to one skilled in the art that modifications can be made to the illustrated embodiments without departing from the spirit and scope of the invention as defined in the claims. Although each of the alternate embodiments show a plurality of passages, only one passage is required. Although each of the alternate embodiments show a plurality of direction changes, two direction changes would be sufficient to make it difficult to thread a rope through the passage. Although the circular and elongate slot are preferred shapes for the cross-sectional areas of the passages, an elliptical shape would also be suitable.

The embodiments of the invention in which an exclusive property or privilege is claimed are defined as follows:

1. A grille for security institutions, comprising:

a. a body having two opposed faces, one of the opposed faces being generally planar and devoid of any appendage, thereby precluding attachment of an object thereto;

b. openings in the planar opposed face being restricted to a plurality of continuous passages extending through the body between the opposed faces, the passages having at least two changes in direction and defining a generally zig zag course such that when rope-like suspension means are inserted into the passage the series of directional changes severely limit the ability of a person to thread the rope-like suspension means through the passage, and c. a cross-sectional area of said passages being elliptical, thereby severely restricting the shape of an object that can be inserted into the passage and the ability of a person to lodge such object transversely in the passage.

2. The grille as defined in claim 1, the cross-section being generally circular.

3. A grille for a security institution, comprising:

a body having two opposed faces, one of the opposed faces being generally planar and devoid of any appendage, thereby precluding attachment of an object thereto;

openings in the planar opposed face being restricted to a plurality of continuous elongate fixed passages extending through the body between the opposed faces, each of the passages having at least two changes in direction thereby to define a generally zig zag course such that when a suspension member is attempted to be inserted into a said passage, the at least two directional changes substantially hindering the ability of a person to thread the suspension member through a said passage, and each said passage having a substantially uniform transverse cross-sectional area along its length.

4. The grille as defined in claim 3, wherein the substantially uniform cross sectional area is elliptical.

5. The grille as defined in claim 3, wherein the substantially uniform cross sectional area is in the shape of an elongated slot.

6. A grille for a security institution, comprising:

a body having two opposed faces, one of the opposed faces being generally planar and devoid of any appendage,.thereby precluding attachment of an object thereto;

openings in the planar opposed face being restricted to a plurality of continuous elongate passages extending through the body between the opposed faces, each of the passages having at least two changes in direction thereby to define a generally zig zag course such that when a suspension member is attempted to be inserted into a said passage, the at least two directional changes substantially hindering the ability of a person to thread the suspension member through a said passage, and each said passage having a substantially uniform transverse cross-sectional area along its length; and the substantially uniform transverse cross sectional area is circular.

* * * * *

US005375373C1

(12) EX PARTE REEXAMINATION CERTIFICATE (6198th)

United States Patent

Tiede

(10) Number: US 5,375,373 C1

(45) Certificate Issued: Apr. 22, 2008

(54) GRILLE FOR SECURITY INSTITUTIONS

(75) Inventor: Irvin R. Tiede, Sherwood Park (CA)

(73) Assignee: Safety Concepts Inc., Sherwood Park, Alberta (CA)

Reexamination Request:
No. 90/008,283, Mar. 23, 2007

Reexamination Certificate for:

| | |
|---|---|
| Patent No.: | **5,375,373** |
| Issued: | **Dec. 27, 1994** |
| Appl. No.: | **08/147,899** |
| Filed: | **Nov. 4, 1993** |

Related U.S. Application Data

(63) Continuation of application No. 08/009,656, filed on Jan. 27, 1993, now abandoned.

(30) Foreign Application Priority Data

Jan. 29, 1992 (CA) ..... 2060234

(51) Int. Cl.

| | |
|---|---|
| ***E06B 9/01*** | (2006.01) |
| ***E06B 7/08*** | (2006.01) |
| ***E06B 3/68*** | (2006.01) |
| ***F24F 13/08*** | (2006.01) |

(52) U.S. Cl. ..... 49/50; 52/473; 454/82

(58) Field of Classification Search ..... None
See application file for complete search history.

(56) References Cited

U.S. PATENT DOCUMENTS

| | | | |
|---|---|---|---|
| 808,897 | A | 1/1906 | Carrier |
| 1,118,365 | A | 11/1914 | Loehler |
| 1,323,978 | A | 12/1919 | Gebhardt |
| 1,588,402 | A | 6/1926 | Frohlich |
| 1,977,719 | A | 10/1934 | Forsell |
| 2,808,900 | A | 10/1957 | Miller, Jr. et al. |
| 2,925,457 | A | 2/1960 | Lindgren |
| D194,410 | S | 1/1963 | Bishop |
| 3,285,156 | A | 11/1966 | Bohanon |
| 3,348,466 | A | 10/1967 | Lane et al. |
| 3,628,442 | A | 12/1971 | Nijhuis |
| 3,847,336 | A | 11/1974 | Morris et al. |
| 3,873,151 | A | 3/1975 | Morris et al. |

FOREIGN PATENT DOCUMENTS

| | | |
|---|---|---|
| GB | 542679 | 1/1942 |

OTHER PUBLICATIONS

Carnes Catalog R–80F, Models RGLAH, RGLAS, and RGLAD, Jul. 1988.

Krueger Manufacturing Co., Model Nos. 600D, 600CD, 610; 601C; and 610A, p. 12, catalog dated Apr. 1988.

A–J Manufacturing Co., No. 75–B, p. 13, catalog dated Dec. 1, 1952.

J&J Model 700CD, p. 20, catalog dated Sep. 1988.

Barber–Colman Company, Air Distribution Application Manual, Condensed Catalog F–16709, dated Apr. 1977.

Arrow United Industries, Inc., No. 550–F Type E–47, p. 11, catalog dated Mar. 1985.

Arrow United Industries, Inc., Index Vertical Louvers, catalog dated Mar. 1985.

*Primary Examiner*—Jeanne M Clark

(57) ABSTRACT

A grille for security institutions consists of a body having two opposed faces. At least one passage extends through the body between the opposed faces. The passage has at least two changes in direction defining a generally zig zag course. When a rope is inserted into the passage the series of direction changes severely limit the ability of a person to thread the rope through the passage.

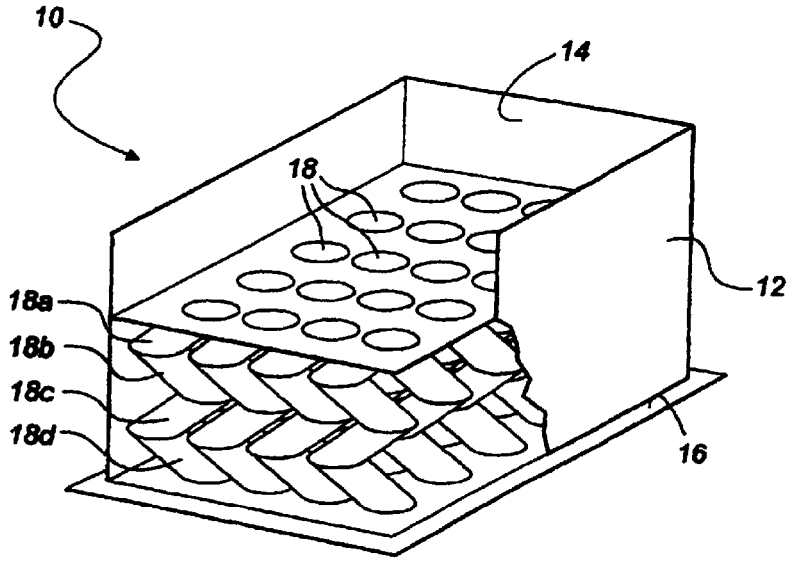

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 3 and 5 are cancelled.

Claims 4 and 6 are determined to be patentable as amended.

New claims 7–9 are added and determined to be patentable.

Claims 1 and 2 were not reexamined.

4. [The grille as defined in claim 3,] *A grille for a security institution, comprising:*

*a body having two opposed faces, one of the opposed faces being generally planar and devoid of any appendage, thereby precluding attachment of an object thereto;*

*openings in the planar opposed face being restricted to a plurality of continuous elongate fixed passages extending through the body between the opposed faces, each of the passages having at least two changes in direction thereby to define a generally zig zag course such that when a suspension member is attempted to be inserted into a said passage, the at least two directional changes substantially hindering the ability of a person to thread the suspension member through a said passage, and each said passage having a substantially uniform transverse cross-sectional area along its length,* wherein the substantially uniform cross sectional area is elliptical.

6. A grille for security institution comprising:

a body having two opposed faces, one of the opposed faces being generally planar and devoid of any appendage,[.]thereby precluding attachment of an object thereto;

openings in the planar opposed face being restricted to a plurality of continuous elongate passages extending through the body between the opposed faces, each of the passages having at least two changes in direction thereby to define a generally zig zag course such that when a suspension member is attempted to be inserted into a said passage, the at least two directional changes substantially hindering the ability of a person to thread the suspension member through a said passage, and each said passage having a substantially uniform transverse cross-sectional area along its length; and the substantially uniform transverse cross sectional area is circular.

*7. A grille for a security institution, comprising:*

*a body having two opposed faces, one of the opposed faces being generally planar and devoid of any appendage, thereby precluding attachment of an object thereto;*

*openings in the planar opposed face being restricted to a plurality of continuous elongate fixed passages extending through the body between the opposed faces, each of the passages having at least two changes in direction thereby to define a generally zig zag course such that when a suspension member is attempted to be inserted into a said passage, the at least two directional changes substantially hindering the ability of a person to thread the suspension member through a said passage, and each said passage having a substantially uniform transverse cross-sectional area along its length, each passage being a discrete, self-contained passage, the plurality of passages arranged in a matrix having a plurality of rows and a plurality of columns.*

*8. The grille as defined in claim 7, wherein the substantially uniform cross sectional area is elliptical.*

*9. The grille as defined in claim 7, wherein the substantially uniform cross sectional area is circular.*

* * * * *